United States Patent [19]

Morand

[11] Patent Number: 4,846,412

[45] Date of Patent: Jul. 11, 1989

[54] TWO ROLL SHEET MATERIAL DISPENSER

[75] Inventor: Michel Morand, Montreal, Canada

[73] Assignee: Wyant & Company Limited, Quebec, Canada

[21] Appl. No.: 262,789

[22] Filed: Oct. 26, 1988

Related U.S. Application Data

[63] Continuation-in-part of Ser. No. 128,176, Dec. 3, 1987, abandoned.

[51] Int. Cl.[4] ..... B65H 19/00

[52] U.S. Cl. ..... 242/55.3; 242/55.53; 225/77; 225/91; 225/106; 312/39; 226/171

[58] Field of Search ..... 242/55.2, 55.3, 55.53, 242/56 R; 312/38, 39; 225/39, 46, 47, 77, 91, 106; 226/168, 174, 176, 177, 171

[56] References Cited

U.S. PATENT DOCUMENTS

| | | | |
|---|---|---|---|
| 3,163,446 | 12/1964 | Muncy | 281/11 |
| 3,628,743 | 12/1971 | Bastian et al. | 242/55.3 |
| 3,917,191 | 11/1975 | Graham et al. | 242/55.3 |
| 4,010,909 | 3/1977 | Bastian | 242/55.3 |
| 4,067,509 | 1/1978 | Graham et al. | 242/55.3 |
| 4,106,684 | 8/1978 | Hartbauer et al. | 226/91 |
| 4,165,138 | 8/1979 | Hedge et al. | 312/39 |
| 4,203,562 | 5/1980 | DeLuca et al. | 242/55.3 |
| 4,236,679 | 12/1980 | Jespersen | 242/55.53 |
| 4,317,547 | 3/1982 | Graham et al. | 242/55.3 |
| 4,358,169 | 11/1982 | Filipowicz et al. | 312/39 |
| 4,396,163 | 8/1983 | Graham et al. | 242/55.3 |
| 4,487,375 | 12/1984 | Rasmussen et al. | 242/55.3 |

*Primary Examiner*—David Werner

*Attorney, Agent, or Firm*—Neil W. McDermid

[57] ABSTRACT

A two roll sheet material dispenser cabinet for paper towelling and the like has an automatic transfer system from one roll to the other when one roll is exhausted. The dispenser feeds sheet material sequentially and comprises a cabinet with first and second roll stations and a feed mechanism to feed sheet material from the rolls to a dispensing opening. The feed mechanism has a gripping roller, and a pressure plate pressed against the roller to provide a feed passage between the roller and plate, a feed mechanism rotates the gripping roller, the sheet material from one roll station is retained in the feed passage while sheet material from the other roll station is dispensed. When the sheet material from one roll station is exhausted, the feed mechanism automatically dispenses sheet material from the other station.

16 Claims, 3 Drawing Sheets

TWO ROLL SHEET MATERIAL DISPENSER

This application is a continuation-in-part of application Ser. No. 128,176, filed 12/3/87, now abandoned.

The present invention relates to a sheet material dispenser and more specifically to a dispenser for paper towelling with two rolls of paper therein and an automatic transfer system transferring from one roll to the other without levers or other mechanisms.

There are many types of dispensing cabinets for paper towelling on the market today. Such dispensers are generally used in washrooms and the like. Some of these dispensers have one roll of paper towelling therein which requires refilling at frequent intervals. Other dispensers have two rolls of paper towelling with a manually operated mechanism to transfer the paper towelling dispensing from one roll to disperse from the other roll as soon as one roll is exhausted. However, most of these transfer mechanisms involve a number of moving parts. In some cases a lever has to be pushed and these are often missing and damaged in public washrooms, particularly when the dispensers are empty.

It is an aim of the present invention to provide a dispenser containing two rolls of paper towelling which can be sequentially dispensed without having any form of manual transfer mechanism for changing from the first roll to the second roll.

It is a further aim of the present invention to provide a dispenser for sheet material which holds two rolls, a first roll, which may be an end roll, feeding sheet material through a friction drive mechanism and a second roll which may be a full roll having an end of sheet material positioned in the drive mechanism, but arranged to stay in place and not be dispensed until the first roll is exhausted.

It is a still further aim of the present invention to provide a dispenser for feeding sheet material which has sides surrounding the dispensing opening so that when the sheet material is pulled from the dispenser, it is pulled upwards rather than sideways and tears easily rather than jamming in the dispenser. It is also an aim to provide a dispenser which has an easily operated dispensing mechanism rather than trying to pull paper towelling from the dispenser with wet hands.

Yet another aim of the present invention is to provide a dispenser for feeding sheet material, such as paper towelling, wherein the dispensing occurs by pushing a spring loaded handle inwards towards the wall so the sheet material feeds sequentially for each push. The action of pushing in towards the wall is an easier operation for handicapped people than most paper towelling dispensers which normally require rotating a crank or raising and/or lowering a lever.

The present invention provides in a dispenser for sequentially feeding sheet material such as paper towelling from rolls of sheet material, including a cabinet adapted to be attached to a wall, the cabinet having a dispensing opening for the sheet material, a first roll station in the lower portion of the cabinet, a second roll station above the first roll station, the improvement of a feed mechanism for feeding sheet material through the dispensing opening comprising at least one gripping roller, pivoted pressure plate having pressure means to press the plate against the gripping roller to provide a feed passage for the sheet material between the gripping roller and the pressure plate, feed means to rotate the gripping roller and feed sheet material adjacent the gripping roller through the feed passage to the dispensing opening, retaining means for retaining the sheet material from the second roll station positioned in the feed passage between the sheet material from the first roll station and the pressure plate when the sheet material from the first roll station is in the feed passage adjacent the gripping roller, the retaining means preventing the sheet material from the second roll station from feeding until the sheet material from the first roll station is exhausted, at which time rotation of the gripping roller feeds the sheet material from the second roll station through the dispensing opening.

In another embodiment the present invention provides in a dispenser for sequetially feeding sheet material such as paper towelling from rolls of sheet material, including a cabinet adapted to be attached to a wall, the cabinet having a dispensing opening for the sheet material, a first roll station in the lower portion of the cabinet, a second roll station above the first roll station, the improvement of a method of feeding sheet material from rolls of sheet material in both roll stations sequentially, comprising the steps of: feeding sheet material from a roll in the first roll station through a feed passage between a gripping roller and a pressure plate to the dispensing opening, positioning sheet material from a roll in the second roll station through the feed passage between the sheet material from the roll in the first roll station and the pressure plate, and preventing sheet material from the roll in the second roll station positioned in the feed passage, from feeding through the feed passage when rotation of the gripping roller feeds sheet material from the roll in the first roll station through the feed passage to the dispensing opening until the sheet material from the roll in the first roll station is exhausted, at which time rotation of the gripping roller feeds the sheet material from the roll in the second roll station through the feed passage to the dispensing opening.

In drawings which illustrate embodiments of the invention:

Figure 2:
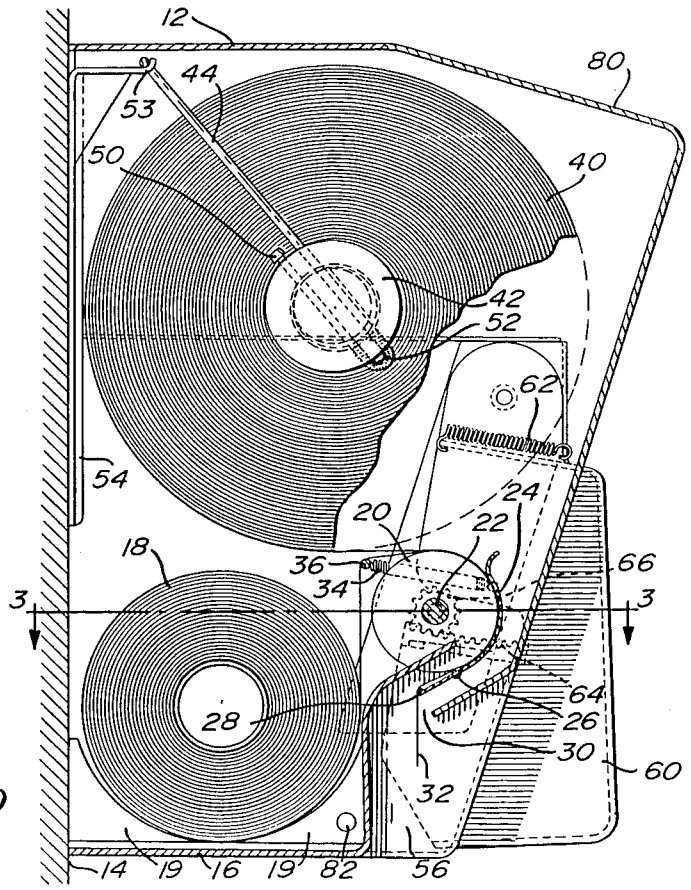
FIG. 2 is a sectional side view of the dispenser shown in FIG. 1.
Figure 1:
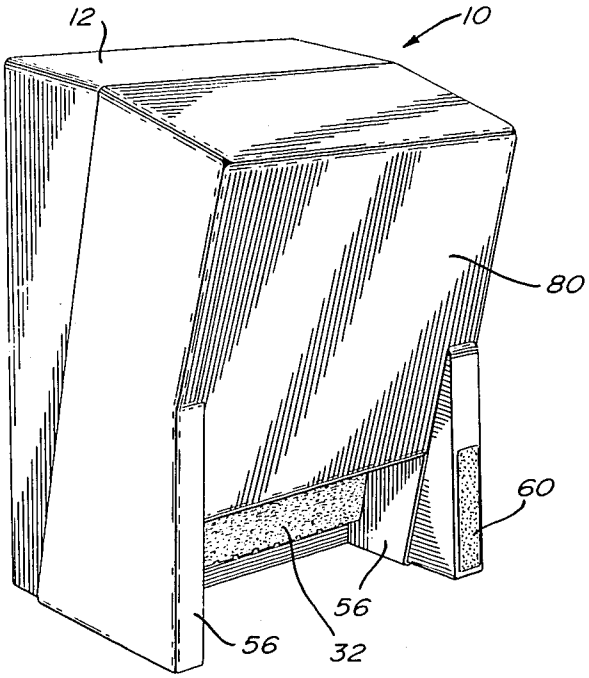
FIG. 1 is an isometric view of a dispenser according to one embodiment of the present invention.

Referring now to the drawing, the dispenser has a cabinet 10 with a main frame 12 which is attached to a wall 14 as shown in FIG. 2. The attachment may be by screws or other means which are not illustrated. The cabinet frame 12 has a trough 16 at its base for containing a towelling sheet roll 18 in a first roll station. The first roll 18 is a small roll or stub roll generally a portion of the roll that is left when a maintenance person refills the dispenser.

Figure 3:
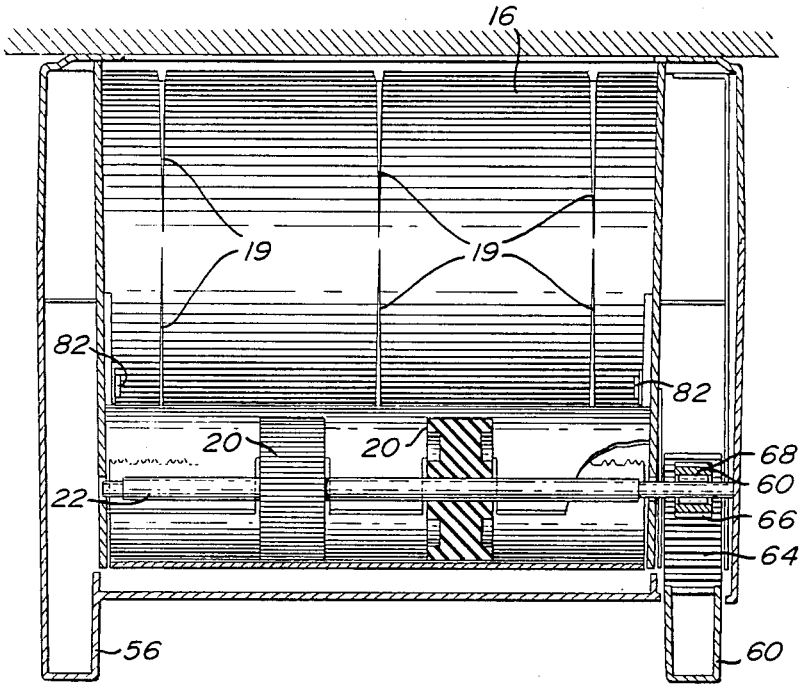
FIG. 3 is a sectional view taken at line 3-3 of FIG. 2.

Curved guide fins 19 are shown in FIGS. 2 and 3 in the trough 16 to centre the first roll 18 while it unwinds. The curvature may be replaced by a straight fin resulting in a V-shaped trough.

Figure 4:
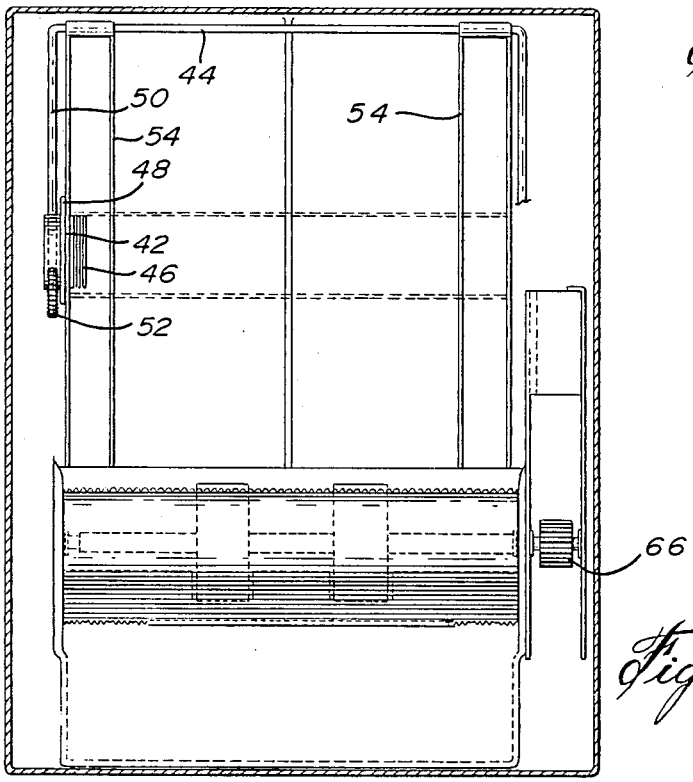
FIG. 4 is a front view of the dispenser shown in FIG. 1 with the front cover removed.

Sheet material or paper towelling from the first roll 18 passes over two ribbed rubber gripping rollers 20 on a roller shaft 22 supported at the sides of the cabinet frame 12. Two rubber gripping rollers 20 are shown in FIG. 3 and 4, however, this number may be changed. One long roller or two or more rollers may be used to perform the function of dispensing paper towelling from the paper towelling rolls. The rubber gripping rollers are ribbed and are reasonably soft so that the ribs grip the towelling sheet. A curved pressure plate 24 extends partially around the circumference of the gripping rollers 20. In the embodiment shown the pressure plate 24 extends about 90° around the gripping rollers 20 for at least the width of the sheet material to provide a feed passage for the sheet material. The pressure plate 24 has a pivot 26 which is connected to the sides of the cabinet frame 12 and slopes down below the pivot point 26 to a serrated edge 28 extending for the full width of the sheet material. A more detailed description of the pressure plate 24 will be described hereafter. The serrated edge 28 is positioned below the top curved edge of the trough 16 in the cabinet frame 12 forming a dispensing opening 30 through which the sheet material or paper towelling 32 is dispensed. Two coiled springs 34 are provided on the top edge corners of the pressure plate 24 which presses the pressure plate 24 against the gripping rollers 20. The springs 34 are attached to a guide rod 36 which extends across the cabinet frame 12 parallel to the roller shaft 22 positioned to act as a guide for paper towelling 32 before entering the gap between the gripping rollers 20 and the pressure plate 24. This guide rod 36 prevents the end of the paper towelling roll 18 from jamming in the cabinet 12 between the gripping rollers 20 and the full towelling roll above.

A full paper towelling roll 40, which as can be seen in FIG. 2 is a larger roll than the first roll 18, is positioned in a second roll station held in place between caps 42 on either side of the roll 40 as shown in FIG. 4. The caps 42 are positioned on the ends of arms of a U-shaped rod frame 44 which is arranged to provide pressure on each of the paper towelling roll 40. The caps 42 have cylindrical locating discs 46 or cups which fit within the ends of the hollow centre portion for each roll, and flanges 48 having surfaces to press against the end surfaces of the roll 40 to provide a braking or friction surface so the roll will not unwind freely. The caps 42 are attached to U-shaped portions 50 on the ends of arms of the U-shaped rod frame 44 to prevent the caps 42 from rotating on the arms. In the embodiment shown, springs 52 extend around the end of the U-shaped portion 50 forming a roll suspension system to act as a shock absorber when sheet material is pulled from the roll 40, they also act as a levelling system to ensure the roll is level in the cabinet 12. The springs 52 help to prevent sheet material "looping", that is the tendancy for the sheet material to wander off center and advance off the roll at a faster rate than it passes through the feed passage between the gripping rollers 20 and the pressure plate 24 causing loops or folds which can jam up in the cabinet 12. The rod frame 44 is pivoted at a pivot position 53 located just away from the top corner of the cabinet 12. Vertical strips 54 are provided on the back of the cabinet 12, as shown in FIGS. 2 and 4. Sheet material from the first roll 18 passes from the underneath of the roll in an anti-clockwise direction as shown in FIG. 2 around the gripping rollers 20 through the feed passage between the gripping rollers 20 and the pressure plate 24 and then exits through the dispensing opening 30. On each side of the dispensing opening 30 are vertical side cabinet walls 56 which ensure that the paper towelling or sheet material is dispensed downwards and when sufficient paper towelling is dispensed it is pulled upwards and torn against the serrated edge 28 of the pressure plate 24. Thus the paper towelling must be pulled up and cannot easily be pulled sideways which can cause jamming in the dispenser.

In order to dispense paper towelling or sheet material, a pivoted release handle 60 has a spring 62 so that it is spring loaded and is located at one of the vertical side walls 56. The release handle 60 has a rack arm 64 which operates a pinion 66 on the gripping roller shaft 22. A one way mechanism such as a one way bearing 68 is provided on the pinion 66 so that rotates the gripping rollers 20 when the pivoted release handle 60 is pushed in towards the wall 14. The pinion 66 then slips around on the shaft 22 when the handle 60 is released. Pushing on the handle 60 in towards the wall dispenses sheet material and it can be pressed a number of times until sufficient length of sheet material extends from the dispensing opening 30. By providing a dispensing action of pushing the handle 60 in towards the wall, the dispenser is more easily used by the handicapped who in some cases cannot operate the present types of paper towelling dispensers having rotating crank arms, or up-down levers. Furthermore, the handle 10 can be pushed in with the forearm or elbow thus avoiding having to touch the handle with wet hands. The sheet material is then lifted up and torn against the serrated edge 28 of the pressure plate 24.

Figure 5:
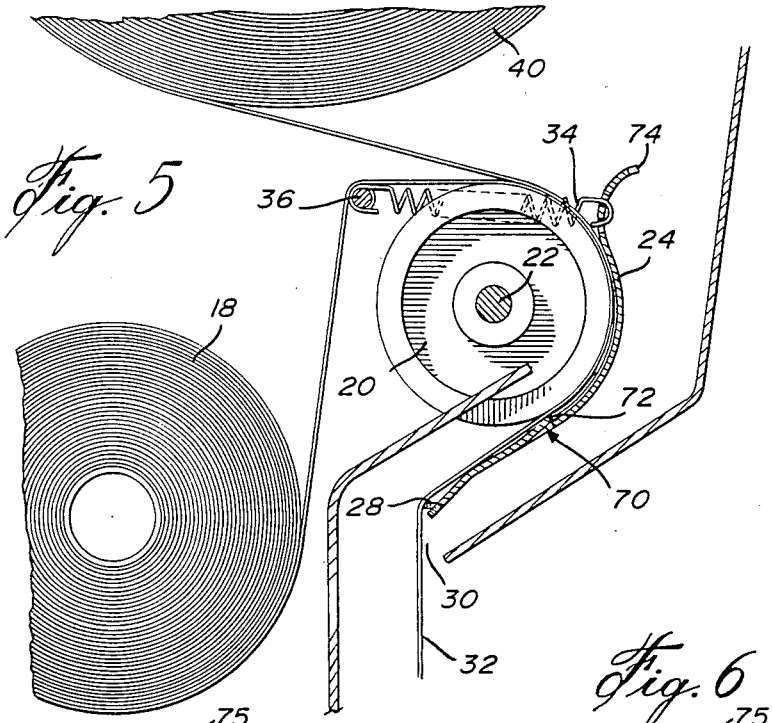
FIG. 5 is a detail sectional view of the arrangement of sheet material from both roll stations positioned between the pressure plate and the gripping rollers.

FIG. 5 shows the positioning of the sheet material from the first roll 18 and the second roll 40 in the feed passage between the gripping rollers 20 and the pressure plate 24. The sheet material from the first roll 18 passes over guide rod 36, around the gripping rolls 20, over the serrated edge 28 of the pressure plate and is discharged through the dispensing opening 30. The sheet material from the second roll 40 is fed on top of the sheet material from the first roll 18. The end of the sheet material is shown folded over and passed into the feed passage between the sheet material from the first roll 18 and the pressure plate 24. As sheet material from the first roll 18 is dispensed, it draws the sheet material from the second roll 40 around to retaining means 70 on the pressure plate 24. The retaining means 70 are preferably formed by cutting out an elongated slot 71 in the center of the plate. The slot 71 extends in a direction parallel with the pivot axis extending between the pivots 26 of the plate 24. The slot 71 can be located just above the pivot axis or with its bottom edge 72 aligned with the pivot axis. The slot 71 is preferably located between the gripping rollers 20. The portion of the plate defining the bottom edge 72 of the slot 71 is pushed inwardly a slight distance to offset the edge 72 from the inner surface 73 of the remainder of the plate. This results in the edge 72 providing a stop to halt the movement of the sheet material from the second roll 40.

When the release handle 60 is pushed in, it rotates the gripping rollers 20 and the sheet material from the first roll 18 feeds through the feed passage and the dispensing opening 30. The fold or end of the sheet material from the second roll 40 remains against the bottom edge 72 of the slot 71 on the pressure plate 24 and does not feed out through the dispensing opening.

When the first roll 18 is completely exhausted, the end of the sheet material passes out through the dispensing opening 30 and the gripping rollers 20 then grip the sheet material which is already in position from the second roll 40 pulling it over the edge 72 on the pressure plate 24 and proceeds to dispense sheet material from this roll.

Figure 6:
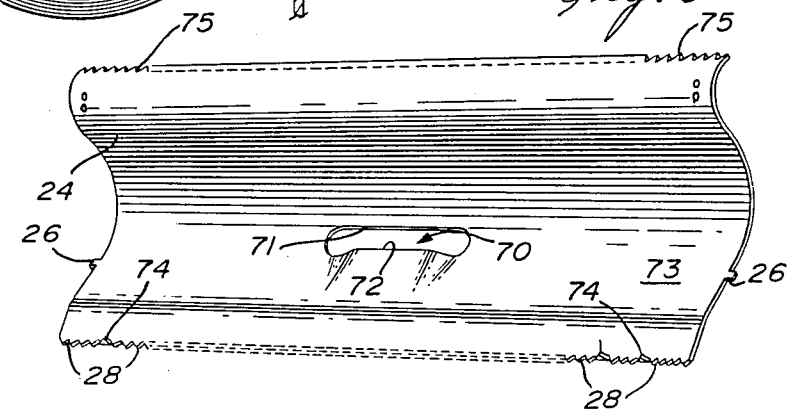
FIG. 6 is an isometric view of the pressure plate.

A detail of the pressure plate 24 is shown in FIG. 6. The bottom serated edge 28 has occasional teeth 74 which act to discourage attempts to pull the sheet material through the dispenser by tearing the web longitudinally in a fashion that makes the sheet material unsatisfactory for use. A top serrated edge 75 is provided at the top of the pressure plate to allow maintenance staff to tear off the leading edge of the sheet material on the new roll and "square" the end of the sheet before positioning it in the feed passage. The leading end of the sheet material from the new roll is preferably "square" when installed in the dispenser. In the embodiment shown, the edge 72 is positioned at an area on the pressure plate 24 not contacted by the gripping rollers 20. However, it may be located under the gripping rollers.

In practice, it has been found that the edge 72 is required for a dispenser to take a variety of different grades of paper towelling. However, if only a single grade of paper towelling is to be used in a dispenser, the slot 71 and thus edge 72 may be omitted, and the coiled springs 34 to press the pressure plate 24 against the gripping rollers 20 are calibrated so that the end of the paper towelling from the second roll 40 remains "packed" in the feed passage until the first sheet material roll 18 is exhausted.

A cover 80 is provided pivoted at the lower corner of the cabinet frame 12 at pivot position 82. The cover 80 may have a lock (not shown) at the top so that it can only be opened by maintenance staff. The cover pivots downwards, but does not include any of the operating mechanism so that when it is in the open position it does not affect operation of the dispenser. The cabinet side walls 56 are, however, part of the cover 80 although the operating handle 60 is attached to the cabinet frame 12 rather than the cover 80.

In operation, a maintenance staff first installs a full roll in the second roll station 40, and feeds the sheet material through the feed passage between the gripping rollers 20 and the pressure plate 24 and out through the dispensing opening 30. When the roll is partially used, it is removed from the roll in the second roll station 40 carrier and lowered into the first roll station 18 without removing the sheet material from the feed passage. A new full roll is then placed in the second roll station 40 and the leading end of the sheet material squared and folded over and fed down through the feed passage between the existing sheet material 32 from the old roll in the first roll station 18 and the pressure plate 24 by pulling the top of the pressure plate 24 away from the gripping rollers 20. The release handle 60 is pushed once or twice to move the leading end of the new roll as far as the edge 72 on the pressure plate 24, where it is parked awaiting exhaustion of the roll in the first roll station.

The sheet material from the roll in the second roll station 40 is dispensed when the sheet material from the roll in the first roll station 18 is exhausted. When the maintenance staff come to refill the dispenser unit at a later date, the roll in the second roll station 40 which may by that time have been reduced considerably in size is lowered into the first roll station 18 and thus the smaller roll is used up before a new full roll is commenced.

Figure 7:
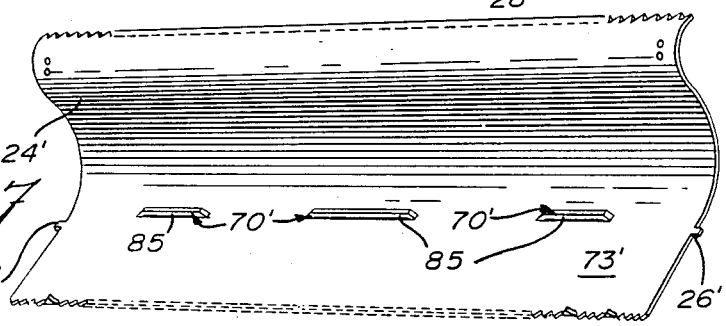
FIG. 7 is an isometric view of another embodiment of the pressure plate.

In another embodiment of the invention as shown in FIG. 7, the retaining means 70' on the pressure plate 24' may take the form of a line of protrusions 85 formed on the plate 24'. The protrusions 85 project inwardly from the inner surface 73 of the plate, and can be formed by pressing or dimpling the plate. The protrusions 85 are located on a line extending parallel to and aligned with or located just above the pivot axis of the plate extending between pivots 26'. The protrusions 85 can be located between and on either side of the gripping rollers 20. The protrusions 85 provide a stop to halt movement of the sheet material from the second roll in the same manner as does edge 72 of slot 71.

In the embodiments shown, the first roll station 18 of the dispenser contains a smaller roll than the second roll station 40, however, the design may be changed so that the first roll station 18 can take the same size rolls as the second roll station 40.

The cabinet 10 may be made out of sheet metal or molded from plastic material. Similarly the pressure plate 24 may be a metal sheet or a hard rigid plastic.

Preferred embodiments of the invention are illustrated by way of examples. It is to be expressly understood, however, that the description and drawings are only for the purpose of illustration and as an aid to understanding, and are not intended as a definition of the limits of the invention.

The embodiment of the invention in which an exclusive property or privilege is claimed are defined as follows.

1. In a dispenser for sequentially feeding sheet material such as paper towelling from rolls of sheet material, including:

a cabinet adapted to be attached to a wall, the cabinet having a dispensing opening for the sheet material;

a first roll station in the lower portion of the cabinet;

a second roll station above the first roll station;

the improvement of a feed mechanism for feeding sheet material through the dispensing opening comprising:

at least one gripping roller;

pivoted pressure plate having pressure means to press the plate against the gripping roller to provide a feed passage for the sheet material between the gripping roller and the pressure plate;

feed means to rotate the gripping roller and feed sheet material adjacent the gripping roller through the feed passage to the dispensing opening;

retaining means for retaining the sheet material from the second roll station, positioned in the feed passage between the sheet material from the first roll station and the pressure plate when the sheet material from the first roll station is in the feed passage adjacent the gripping roller, the retaining means preventing the sheet material from the second roll station from feeding until the sheet material from the first roll station is exhausted, at which time rotation of the gripping roller feeds the sheet material from the second roll station through the dispensing openings.

2. The dispenser according to claim 1 wherein the pressure plate extends partially around the circumference of the gripping roller.

3. The dispenser according to claim 2 wherein the pressure plate extends for at least about 90° around the circumference of the gripping roller.

4. The dispenser according to claim 1 wherein the retaining means comprises an elongated slot in the pressure plate with the lower edge of the slot offset from the remainder of the plate.

5. The dispenser according to claim 4 wherein the gripping roller comprises at least two rubber ribbed rollers supported on a shaft and the slot on the pressure plate is positioned between the rollers.

6. The dispenser according to claim 1 wherein the retaining means comprises at least one calibrated spring forming the pressure means pressing the pressure plate against the gripping roller to prevent a predetermined grade of sheet material from the second roll station from feeding until the sheet material from the first roll station is exhausted.

7. The dispenser according to claim 1 including a serrated edge at a lower edge of the pressure plate to assist in tearing a length of sheet material from the dispenser.

8. The dispenser according to claim 1 wherein the feed means comprises a spring loaded pivoted release handle with a movement in towards the wall, the handle connected to a rack engaging with a pinion on a shaft supporting the gripping roller, the pinion having a one way mechanism so rotation of the gripping roller occurs in only one direction to feed sheet material.

9. A dispenser for sequentially feeding sheet material such as paper towelling from rolls of sheet material comprising:

a cabinet adapted to be attached to a wall, the cabinet having a dispensing opening for the sheet material and side walls on each side of the dispensing opening;

a first roll station in the lower portion of the cabinet;

a second roll station above the first roll station;

at least one gripping roller to grip the sheet material;

pivoted pressure plate having pressure means to press the plate against the gripping roller to provide a feed passage for the sheet material between the gripping roller and the pressure plate, the pressure plate having a serrated lower edge for tearing the sheet material;

feed means to rotate the gripping roller and feed sheet material adjacent the gripping roller through the feed passage to the dispensing opening;

retaining means for retaining the sheet material from the second roll station, positioned in the feed passage between the sheet material from the first roll station and the pressure plate when the sheet material from the first roll station is in the feed passage adjacent the gripping roller, the retaining means preventing the sheet material from the second roll station from feeding until the sheet material from the first roll station is exhausted, at which time rotation of the gripping roller feeds the sheet material from the second roll station through the dispensing opening.

10. The dispenser according to claim 9 wherein in the second roll station a roll of sheet material is supported on a swinging arm and is held between two friction surfaces to prevent premature unrolling.

11. The dispenser according to claim 10 including a roll suspension system acting as a shock absorber for a roll of sheet material in the second roll station to restrain looping or folding of sheet material coming off the roll.

12. The dispenser according to claim 9 wherein an external cover is provided for the cabinet to pivot downwards for installation of rolls, removal of the external cover not affecting operation of the dispenser.

13. The method of sequentially feeding sheet material, such as paper towelling from rolls of sheet material, from a dispenser having:

a cabinet adapted to be attached to a wall, the cabinet having a dispensing opening for the sheet material;

a first roll station in the lower portion of the cabinet;

a second roll station above the first roll station;

the method comprising the steps of:

feeding sheet material from a roll in the first roll station through a feed passage between a gripping roller and a pressure plate to the dispensing opening;

positioning sheet material from a roll in the second roll station through the feed passage between the sheet material from the roll in the first roll station and the pressure plate, and preventing sheet material from the roll in the second roll station positioned in the feed passage, from feeding through the feed passage when rotation at the gripping roller feeds sheet material from the roll in the first roll station through the feed passage to the dispensing opening, until the sheet material from the roll in the first roll station is exhausted, at which time rotation of the gripping roller feeds the sheet material from the roll in the second roll station through the feed passage to the dispensing opening.

14. The method of feeding sheet material according to claim 13 wherein feeding the sheet material occurs sequentially by pushing a handle in towards the wall.

15. The dispenser according to claim 1 wherein the retaining means comprises protrusions on the pressure plate.

16. The dispenser according to claim 15 wherein the gripping roller comprises at least two rubber ribbed rollers supported on a shaft and the protrusions on the pressure plate are positioned between and on each side of the ribbed rollers.

* * * * *